US009936732B2

(12) United States Patent
Liu

(10) Patent No.: US 9,936,732 B2
(45) Date of Patent: Apr. 10, 2018

(54) ELECTRONIC CIGARETTE

(71) Applicant: KIMREE HI-TECH INC., RoadTown, Tortola (VG)

(72) Inventor: Qiuming Liu, Guangdong (CN)

(73) Assignee: HUISHOU KIMREE TECHNOLOGY CO., LTD. SHENZHEN BRANCH, Shenzhen, Guangdong (CN)

( * ) Notice: Subject to any disclaimer, the term of this patent is extended or adjusted under 35 U.S.C. 154(b) by 406 days.

(21) Appl. No.: 14/712,203

(22) Filed: May 14, 2015

(65) Prior Publication Data

US 2015/0296889 A1 Oct. 22, 2015

Related U.S. Application Data

(63) Continuation of application No. PCT/CN2014/075597, filed on Apr. 17, 2014.

(51) Int. Cl.
*A24F 47/00* (2006.01)

(52) U.S. Cl.
CPC ..... *A24F 47/008* (2013.01)

(58) Field of Classification Search
CPC ..... C12M 47/02; C12M 23/44; A24F 47/008
See application file for complete search history.

(56) References Cited

U.S. PATENT DOCUMENTS

| | | | | |
|---|---|---|---|---|
| 2006/0196518 | A1* | 9/2006 | Hon | A24F 47/002 131/360 |
| 2013/0081642 | A1 | 4/2013 | Safari | |
| 2014/0190502 | A1* | 7/2014 | Liu | A24F 47/008 131/329 |

FOREIGN PATENT DOCUMENTS

| | | | |
|---|---|---|---|
| CN | 202276832 | U | 6/2012 |
| CN | 202999299 | U | 6/2013 |
| CN | 203182012 | U | 9/2013 |
| CN | 203353686 | U | 12/2013 |
| CN | 203378559 | U | 1/2014 |
| CN | 203424295 | U | 2/2014 |
| CN | 203446531 | U | 2/2014 |
| CN | 203457810 | U | 3/2014 |

OTHER PUBLICATIONS

International Search Report corresponding to Application No. PCT/CN2014/075597; dated Dec. 30, 2014.

* cited by examiner

*Primary Examiner* — Gautam Prakash
(74) *Attorney, Agent, or Firm* — U.S. Fairsky LLP; Yue Xu

(57) ABSTRACT

An electronic cigarette for preventing mutual rotation of an atomizing assembly and a battery assembly is provided. The battery assembly and the atomizing assembly of the electronic cigarette are connected by magnetic attraction. The atomizer connecting end is provided with a retaining member with a corner angle; the battery connecting end is provided with an accommodating cavity which allows the atomizer connecting end to be inserted therein; and the accommodating cavity is provided with a guiding retaining groove allowing the retaining member to be inserted therein. When the battery assembly and the atomizing assembly are connected by magnetic attraction, the mutual rotation can be interfered and restrained as the connection section has the corner angles, and the atomizing assembly and the battery assembly can not rotate with respect to one another.

16 Claims, 5 Drawing Sheets

ELECTRONIC CIGARETTE

CROSS REFERENCE TO RELATED APPLICATIONS

This application is a continuation under 35 U.S.C. § 120 of PCT/CN2014/075597, filed Apr. 17, 2014, which is incorporated herein reference.

FIELD

The present application relates to the technical field of electronic cigarettes, and particularly to an electronic cigarette capable of preventing mutual rotation of an atomizing assembly and a battery assembly.

BACKGROUND

As the improvement of health consciousness, more and more people are aware of the perniciousness of smoking, thus, an electronic cigarette, which is healthier than the cigarette, is welcomed.

A conventional electronic cigarette includes a battery assembly and an atomizing assembly. When a user smokes the electronic cigarette, the internal pressure of the electronic cigarette is changed, and an airflow sensor inside the battery assembly senses the pressure change and sends a signal to a controller inside the electronic cigarette, then according to the signal, the controller controls a heating wire inside the atomizing assembly to atomize a cigarette liquid stored in a liquid storage cotton to generate smoke. In this way, the user has completed a smoking process.

Functional components in the electronic cigarette are powered by a battery in the battery assembly. The battery assembly and the atomizing assembly are separately formed and then connected. A connecting portion of the battery assembly for connecting the atomizing assembly is provided with an electrode connecting end, and the electrode connecting end is connected to each functional component by an electronic wire to provide electric energy, thus in this way, a power supply circuit is formed. The battery assembly and the atomizing assembly can rotate with respect to each other by any angle, in the rotating process, the electrode is apt to drive the electronic wires, thus the electronic wires may knot to cause short circuit or open circuit, and the electronic cigarette can not work normally. In addition, the battery assembly and the atomizing assembly can rotate with respect to each other by any angle, thus, in the long-term use, due to the mutual rotation, the battery assembly and the atomizing assembly may be worn, which may generate a large gap between them, and in this case, the connection therebetween is not reliable and the battery assembly and the atomizing assembly are apt to be disengaged from one another. When smoking, the user worries about that the battery assembly may fall off from the atomizing assembly, thus generally grips at the connecting portion of the battery assembly and the atomizing assembly, which not only causes a poor user experience, but also may burn fingers of the user when touching the atomizer for a long time.

SUMMARY

An electronic cigarette is provided in the present application, which is capable of preventing mutual rotation of an atomizing assembly and a battery assembly, to solve the problems that the battery assembly and the atomizing assembly after being connected can rotate with respect to each other by any angle, and in the rotating process, the electrode is apt to drive the electronic wires, thus the electronic wires may knot to cause short circuit or open circuit, and the electronic cigarette can not work normally, and further the battery assembly and the atomizing assembly are apt to be disengaged from one another, and in using, the electronic cigarette may cause a poor user experience, and may burn fingers of the user.

To solve the problems, the following technical solutions are provided according to the present application.

An electronic cigarette includes a battery assembly and an atomizing assembly;

the atomizing assembly is provided with an atomizer connecting end configured to be connected to the battery assembly, and the atomizer connecting end is provided with a first magnetic member;

the battery assembly is provided with a battery connecting end configured to cooperate with the atomizer connecting end, and the battery connecting end is provided with a second magnetic member configured to be connected to the first magnetic member by magnetism attraction;

the battery connecting end is provided with an accommodating cavity which allows the atomizer connecting end to be inserted therein; a side wall of the accommodating cavity is provided with a guiding retaining groove which extends along an axial direction or a circumferential direction of the electronic cigarette to an end surface of an opening of the accommodating cavity, and a wall of the guiding retaining groove is provided with a corner angle; the atomizer connecting end is provided with a retaining member configured to be inserted in the guiding retaining groove, and the retaining member has a corner angle and is configured to abut against the guiding retaining groove to prevent mutual rotation of the atomizing assembly and the battery assembly; or the atomizer connecting end is provided with the accommodating cavity which allows the atomizer connecting end to be inserted therein; a side wall of the accommodating cavity is provided with the guiding retaining groove; and the battery connecting end is provided with the retaining member.

In the electronic cigarette according to the present application, the battery connecting end is provided with a guiding retaining groove seat;

the guiding retaining groove is provided at a side wall of the guiding retaining groove seat; and the retaining member is a protrusion arranged at an outer portion of the atomizing assembly along the axial direction of the electronic cigarette, and the protrusion is configured to be inserted into the guiding retaining groove to prevent the mutual rotation of the atomizing assembly and the battery assembly.

In the electronic cigarette according to the present application, at least one protrusion is provided, and at least two guiding retaining grooves are provided.

In the electronic cigarette according to the present application, a length of the protrusion along an axial direction of the atomizer connecting end is less than or equal to an axial length of the atomizer connecting end.

In the electronic cigarette according to the present application, the protrusion is a semicircle with elasticity, and the guiding retaining groove is a semicircular groove.

In the electronic cigarette according to the present application, the retaining member is a protruding snap ring provided with an embossment along the axial direction of the electronic cigarette;

the protruding snap ring is fixedly connected to the atomizer connecting end;

the accommodating cavity of the battery connecting end is provided with a groove ring configured to cooperate with the protruding snap ring;

a wall of the groove ring is provided with a guiding retaining groove; and the guiding retaining groove is configured to allow the embossment of the protruding snap ring to be inserted therein, to prevent the mutual rotation of the atomizing assembly and the battery assembly.

In the electronic cigarette according to the present application, the protruding snap ring and the groove ring are made of plastic material;

the protruding snap ring and the atomizer connecting end are connected by injection molding; and the groove ring and the battery connecting end are connected by injection molding.

In the electronic cigarette according to the present application, the atomizer connecting end has a polygonal prism structure, and the accommodating cavity of the battery connecting end is a hollow polygonal prism configured to cooperate with the atomizer connecting end and to allow the atomizer connecting end to be inserted therein;

or, the atomizer connecting end is a hollow polygonal prism configured to cooperate with the battery connecting end and to allow the battery connecting end to be inserted therein, and the battery connecting end has a polygonal prism structure.

In the electronic cigarette according to the present application, the polygonal prism is a trilateral polygonal prism or a quadrilateral polygonal prism.

In the electronic cigarette according to the present application, an outer portion of the polygonal prism of the atomizer connecting end is provided with an embossment along the axial direction of the electronic cigarette, and the accommodating cavity of the battery connecting end is provided with a groove configured to cooperate with the embossment and to allow the embossment to be inserted therein;

or, the hollow polygonal prism of the atomizer connecting end is provided with a groove, and an outer portion of the polygonal prism of the battery connecting end is provided with an embossment along the axial direction of the electronic cigarette; and the embossment is a magnet; and a wall of the groove is made of magnetic material.

In the electronic cigarette according to the present application, the accommodating cavity of the battery connecting end is an arched groove which is formed by cutting a part of arc body from a cylinder along at least one section and is configured to allow the atomizer connecting end to be inserted therein, and the atomizer connecting end is an arched body which is formed by cutting a part of arc body from a cylinder along at least one section and is configured to cooperate with the arched groove to prevent the mutual rotation of the atomizing assembly and the battery assembly;

or, the battery connecting end is formed by cutting a part of arc body from a cylinder along at least one section, and the atomizer connecting end is an arched groove which is formed by cutting a part of arc body from a cylinder along at least one section and is configured to allow the atomizer connecting end to be inserted therein.

In the electronic cigarette according to the present application, an outer portion of the atomizing assembly is provided with a first mark configured to indicate the position of the retaining member; and an outer portion of the battery assembly is provided with a second mark configured to cooperate with the first mark to indicate the connection location.

In the electronic cigarette according to the present application, the retaining member is a magnet, and a wall of the guiding retaining groove is made of magnetic material;

or, the retaining member is made of magnetic material, and a wall of the guiding retaining groove is a magnet.

In the electronic cigarette according to the present application, the battery assembly further includes a spring electrode assembly;

the spring electrode assembly includes a spring, a battery holder and a battery electrode;

the spring has one end fixedly connected to the battery holder, and another end connected to the battery electrode and configured to, under the action of an external force, make the battery electrode to move telescopically under the action of the spring;

the second magnetic member is connected to the battery holder, and is fixed on the battery connecting end;

the atomizing assembly further includes an upper electrode; and the upper electrode is made of magnetic material and functions as the first magnetic member, and is configured to be connected to the second magnetic member by magnetism attraction, to connect the atomizing assembly to the battery assembly.

In the electronic cigarette according to the present application, the second magnetic member is a magnet, and the upper electrode is made of magnetic material;

or, the second magnetic member is made of magnetic material, and the upper electrode is a magnet.

In the electronic cigarette according to the present application, the battery assembly further includes a connection sleeve and a spring electric motor assembly;

the atomizing assembly further includes an upper electrode and an inner electrode; and the connection sleeve and the upper electrode, as well as the spring electric motor assembly and the inner electrode, are electrically connected respectively, to form a closed circuit configured to allow the battery assembly to supply power to internal components of the atomizing assembly.

According to the above technical solutions, the embodiments in the present application have the following advantages.

The battery assembly and the atomizing assembly of the electronic cigarette are connected by magnetic attraction. The atomizer connecting end is provided with the retaining member with the corner angle; the battery connecting end is provided with the accommodating cavity which allows the atomizer connecting end to be inserted therein; the side wall of the accommodating cavity is provided with the guiding retaining groove with the corner angle, which allows the retaining member to be inserted therein. When the battery assembly and the atomizing assembly are connected by the magnetic attraction, the retaining member abuts against the guiding retaining groove since the connecting portion has the corner angles, thereby preventing the mutual rotation of the atomizing assembly and the battery assembly. In this case, the electronic wires will not knot, which avoids short circuit or open circuit, and ensures the normally operation of the electronic cigarette. In addition, the guiding retaining grooves extends along the axial direction or the circumferential direction of the electronic cigarette to the end surface of the opening of the accommodating cavity, which is convenient for the user to perform inserting and assembling. The battery assembly and the atomizing assembly are provided with the guiding retaining groove and the retaining member each having the corner angle, thereby preventing the atomizing assembly and the battery assembly from rotating with respect to one another by any angle. Therefore, even in a long-term use, a large gap won't be generated between the battery assembly and the atomizing assembly due to rotation wear, and the battery assembly and the atomizing assembly are reliably connected by magnetism and are not easy to be disengaged from one another. Thus the user does not need to worry about that the battery assembly will fall off from the atomizing assembly, and when smoking, the user does not need to grip at the connecting portion of the battery assembly and the atomizing assembly, thus will not be burnt for touching the atomizer for a long time.

BRIEF DESCRIPTION OF THE DRAWINGS

In order to more clearly illustrate the embodiments of the present application or the technical solution in the conventional technology, drawings referred to describe the embodiments or the conventional technology will be briefly described hereinafter. Apparently, the drawings in the following description are only a few of embodiments of the present application, and for the person skilled in the art, other drawings may be obtained based on these drawings without any creative efforts.

DETAILED DESCRIPTION OF EMBODIMENTS

The technical solutions in the embodiments of the present application will be described clearly and completely hereinafter in conjunction with the drawings in the embodiments of the present application. Apparently, the described embodiments are only a part of the embodiments of the present application, rather than all embodiments. All of other embodiments, made by the person skilled in the art without any creative efforts based on the embodiments in the present application, fall into the scope of the present application.

Figure 1:
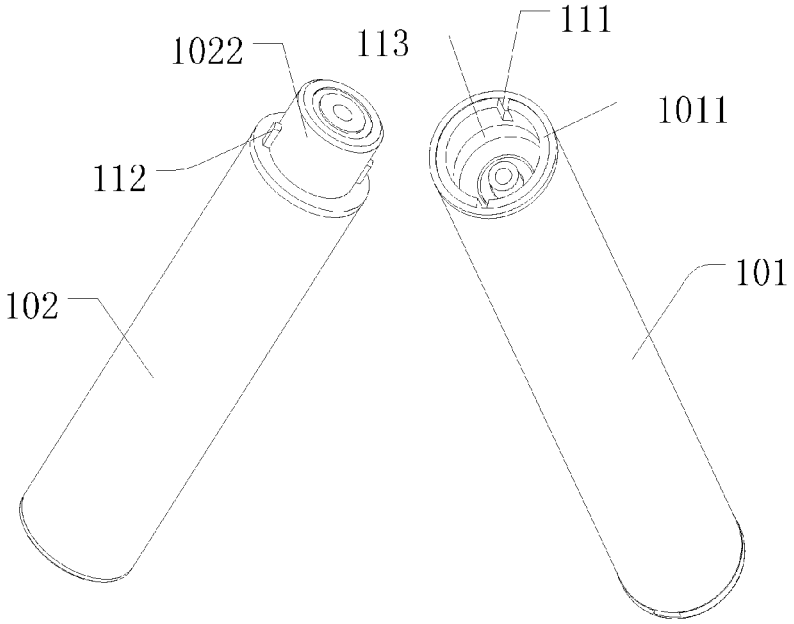
FIG. 1 is an overall structural view of an electronic cigarette according to the present application.

An electronic cigarette is provided according to the present application, which can prevent mutual rotation of an atomizing assembly and a battery assembly, and the structure of the electronic cigarette is shown in FIG. 1.

The electronic cigarette includes a battery assembly 101 and an atomizing assembly 102.

The atomizing assembly 102 is provided with an atomizer connecting end 1022 which is connected to the battery assembly 101, and the atomizer connecting end 1022 is provided with a first magnetic member.

The battery assembly 101 is provided with a battery connecting end 1011 which is configured to cooperate with the atomizer connecting end 1022. The battery connecting end 1011 is provided with a second magnetic member which is configured to be connected to the first magnetic member by magnetic attraction.

The battery connecting end 1011 is provided with an accommodating cavity 113, and the atomizer connecting end can be inserted into the accommodating cavity 113.

A side wall of the accommodating cavity is provided with a guiding retaining groove 111. The guiding retaining groove 111 extends along the axial direction or the circumferential direction of the electronic cigarette to an end surface of an opening of the accommodating cavity, and a wall of the guiding retaining groove 111 has a corner angle.

The atomizer connecting end 1022 is provided with a retaining member 112 configured to be inserted in the guiding retaining groove 111. The retaining member 112 has a corner angle, and is configured to abut against the guiding retaining groove 111 to prevent mutual rotation of the atomizing assembly 102 and the battery assembly 101.

The first magnetic member of the battery connecting end 1011 is connected to the second magnetic member of the atomizer connecting end 1022 by magnetic attraction, that is, the battery assembly 101 is connected to the atomizing assembly 102 by magnetic attraction. The first magnetic member and the second magnetic member may be arranged at the circumferential surface of the respective battery connecting end, and also may be arranged on the end surface of the respective battery connecting end, and the positions of the first magnetic member and the second magnetic member are not limited herein, as long as the magnetic attraction can ensure that the battery assembly 101 and the atomizing assembly 102 are reliably connected and are not easy to be disengaged from each other. The magnetic member may be made of magnetic material, and also may be a magnet, which is not limited herein.

In the present application, the retaining member 112 may be embodied as a protrusion protruding from the connecting end, or, the connecting end may be configured to have a shape having a corner angle, or, a connecting ring having a protrusion with a corner angle may be arranged outside the connecting end, and the detail manners are not limited herein.

Figure 2:
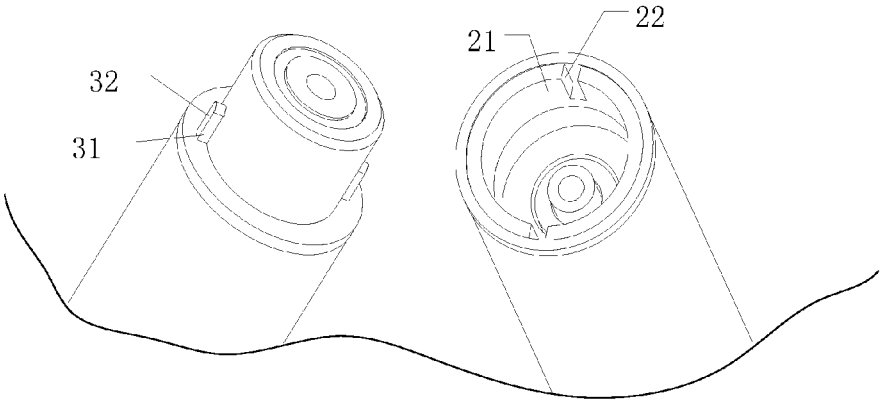
FIG. 2 is a structural view of an atomizer connecting end and a battery connecting end of the electronic cigarette according to an embodiment of the present application.

In the present application, for clearly describing the corner angle, an example of the corner angle is illustrated in FIG. 2. The corner angle of the wall of the guiding retaining groove can be understood as a corner angle with a protruding edge, which is formed by an inner wall 21 of the guiding retaining groove and a first contact surface 22 which is in contact with the retaining member.

The corner angle of the retaining member is a corner angle with a protruding edge, which is formed by an end surface 32 of the retaining member and a second contact surface 31 which is in contact with the guiding retaining groove when the retaining member is inserted into the guiding retaining groove.

The corner angles may also be understood as the connecting ends of the atomizer connecting end 1022 and the battery connecting end 1011, which are of a shape having a corner angle. For example, the connecting end is a cube or a triangular prism, and the specific shape is not limited.

The above description is only for illustrating the corner angle, and is not intended to constitute any limitation. The corner angle mainly functions to prevent mutual rotation of the atomizing assembly 102 and the battery assembly 101.

In the present application, the atomizer connecting end 1022 may be provided with an accommodating cavity 113 which is configured to allow the battery connecting end 1011 to be inserted therein; the side wall of the accommodating cavity is provided with the guiding retaining groove 111; and the battery connecting end 1011 is provided with the retaining member 112. It can be appreciated that, the atomizer connecting end 1022 is provided with the guiding retaining groove 111, and the battery connecting end 1011 is provided with the retaining member 112. The atomizer connecting end 1022 and the battery connecting end 1011 with interchanged structures may generate the same function and effect, which will not be illustrated herein.

It can be appreciated that, the battery assembly and the atomizing assembly of the electronic cigarette are connected by the magnetic attraction. The atomizer connecting end is provided with the retaining member with the corner angle; the battery connecting end is provided with the accommodating cavity which allows the atomizer connecting end to be inserted therein; the side wall of the accommodating cavity is provided with the guiding retaining groove with the corner angle, which allows the retaining member to be inserted therein. When the battery assembly and the atomizing assembly are connected by the magnetic attraction, the retaining member abuts against the guiding retaining groove since the connecting portion has the corner angles, thereby preventing the mutual rotation of the atomizing assembly and the battery assembly. In this case, the electronic wires will not knot, which avoids short circuit or open circuit, and ensures the normally operation of the electronic cigarette. In addition, the guiding retaining grooves extends along the axial direction or the circumferential direction of the electronic cigarette to the end surface of the opening of the accommodating cavity, which is convenient for the user to perform inserting and assembling. The battery assembly and the atomizing assembly are provided with the guiding retaining groove and the retaining member each having the corner angle, thereby preventing the atomizing assembly and the battery assembly from rotating with respect to one another by any angle. Therefore, even in a long-term use, a large gap won't be generated between the battery assembly and the atomizing assembly due to rotation wear, and the battery assembly and the atomizing assembly are reliably connected by magnetism and are not easy to be disengaged from one another. Thus the user does not need to worry about that the battery assembly will fall off from the atomizing assembly, and when smoking, the user does not need to grip at the connecting portion of the battery assembly and the atomizing assembly, thus will not be burnt for touching the atomizer for a long time.

For fully describing the solutions of the present application for solving problems, the following embodiments are illustrated as examples, and are not intended to limit the present application and the specific implementation, and are only for fully illustrating the technical solutions of the present application.

First Embodiment

Figure 3:
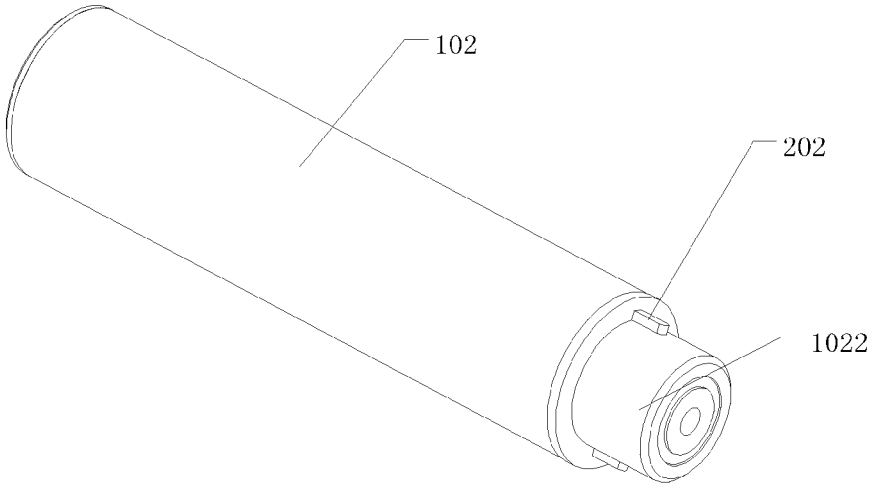
FIG. 3 is a structural view of an atomizing assembly of the electronic cigarette according to an embodiment of the present application.
Figure 4:
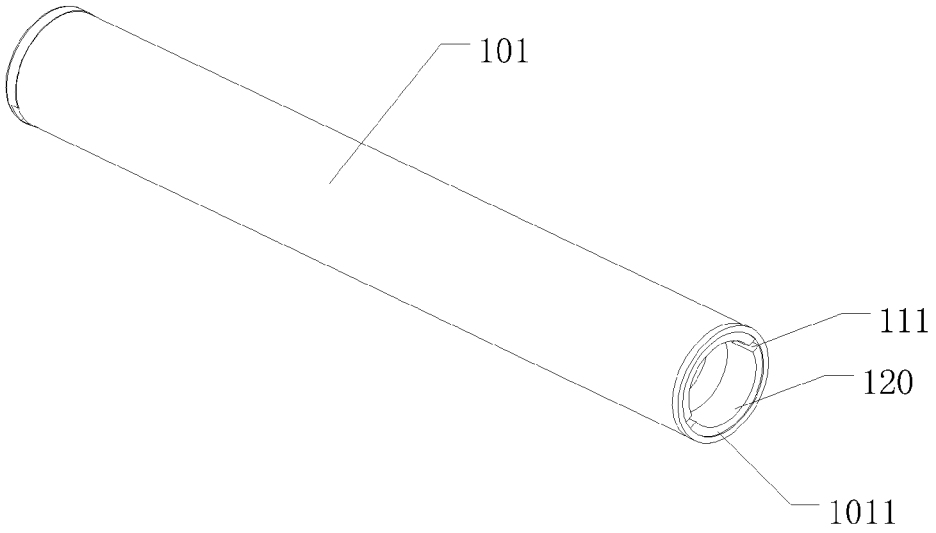
FIG. 4 is a structural view of a battery assembly of the electronic cigarette according to the embodiment of the present application.

In this embodiment, referring to FIG. 3 and FIG. 4, the retaining member is a protrusion 202 arranged at an outer portion of the atomizing assembly.

The battery connecting end 1011 is provided with a guiding retaining groove seat 120.

The guiding retaining groove 111 is arranged on the side wall of the guiding retaining groove seat 120, and is configured to allow the protrusion to be inserted therein, to prevent the mutual rotation of the atomizing assembly 102 and the battery assembly 101.

In this embodiment, most electronic cigarettes are cylindrical to look like the real cigarettes. The atomizer connecting end 1022 is also a solid cylinder, and the cylinder is provided with a protrusion 202 in the axial direction of the electronic cigarette to function as the retaining member. The battery connecting end 1011 is provided with an accommodating cavity 113 for cooperating with the atomizer connecting end 1022. The accommodating cavity 113 is provided with the guiding retaining groove seat 120, and the side wall of the guiding retaining groove seat 120 is provided with the guiding retaining groove 111 which is configured to allow the protrusion 202 to be inserted therein, to prevent the mutual rotation of the atomizing assembly 102 and the battery assembly 101.

In this embodiment, the guiding retaining groove seat 120 is fixed in the accommodating cavity 113. When the atomizer connecting end 1022 is inserted into the accommodating cavity 113 of the battery connecting end 1011, the protrusion 202 is inserted into the guiding retaining groove 111 of the guiding retaining groove seat 120 at the same time.

In this embodiment, at least one protrusion 202 is provided, and at least two guiding retaining grooves 111 are provided.

If the connecting end is provided with one protrusion, the number of the guiding retaining grooves 111 can be two or three or four. The protrusion 202 can correspond to any one of the guiding retaining grooves 111, thus the user has more choices when connecting the battery assembly and the atomizing assemble. In this way, the connection of the atomizing assembly and the battery assembly is convenient, which is unlike the situation that the atomizing assembly and the battery assembly has to be perfectly matched to be connected when one protrusion corresponding to one guiding retaining groove 111.

If there are two protrusions, the number of the guiding retaining grooves 111 can be two or four, which facilitates the user inserting the protrusions into the guiding retaining groove 111. The specific numbers of the protrusions and the guiding retaining groove 111 are not limited herein.

In this embodiment, it is preferable that the number of the protrusions is two, and the number of the guiding retaining grooves 111 is four.

In this embodiment, the protrusion 202 is square, and if the protrusion 202 is arranged on the atomizer connecting end 1022, the length of the protrusion 202 in the axial direction of the atomizer connecting end 1022 is less than or equal to the axial length of the atomizer connecting end 1022. In the case that the length of the protrusion 202 is equal to the axial length of the atomizer connecting end 1022, the protrusion 202 can realize the best effect for preventing rotation of the atomizing assembly and the battery assembly. In the case that the length of the protrusion 202 is less than the axial length of the atomizer connecting end 1022, the minimum length of the protrusion 202 can not less than one-third of the axial length of the atomizer connecting end 1022, otherwise, the effect for preventing rotation is not well.

In this embodiment, the depth of the guiding retaining groove 111 should fit to the length of the protrusion 202. The depth of the guiding retaining groove 111 can be equal to or greater than the length of the protrusion 202, which is not limited herein.

In this embodiment, for realizing better connection of the protrusion 202 and the guiding retaining groove 111, the protrusion 202 is a magnet, the wall of the guiding retaining groove 111 is made of magnetic material. The magnetic attraction makes the connection of the protrusion 202 and the guiding retaining groove 111 more tightly, which ensures the effect for preventing rotation.

In this embodiment, the protrusion 202 and the connecting end can be integrally formed, and can also be separately formed. When the protrusion 202 and the connecting end are separately formed, the protrusion 202 is firstly mounted to the connecting end before connecting the atomizing assembly and the battery assembly. The specific manner is not limited.

In this embodiment, the protrusion 202 may be embodied as a semicircle with elasticity; and the guiding retaining groove 111 is embodied as a semicircular groove. The semicircle matches with the semicircular groove, the number of the semicircular groove may be more than the number of the semicircle, and the positions of the semicircular groove and the semicircle on the connecting ends are not limited. When connecting the atomizing assembly to the battery assembly, the protrusion is pressed to be flush with the end surface of the connecting end while the connecting ends are connected since the semi-circular protrusion has elasticity, thus the protrusion won't interfere the connection, and when the semicircle is arranged in a position corresponding to the semicircular groove, the semicircle pops up to cooperate with the semicircular groove, to prevent rotation.

The height, protruding out of the connecting end, of the semicircle is not limited herein, as long as the height is greater than a half of the length of the semicircular protrusion.

Figure 5:
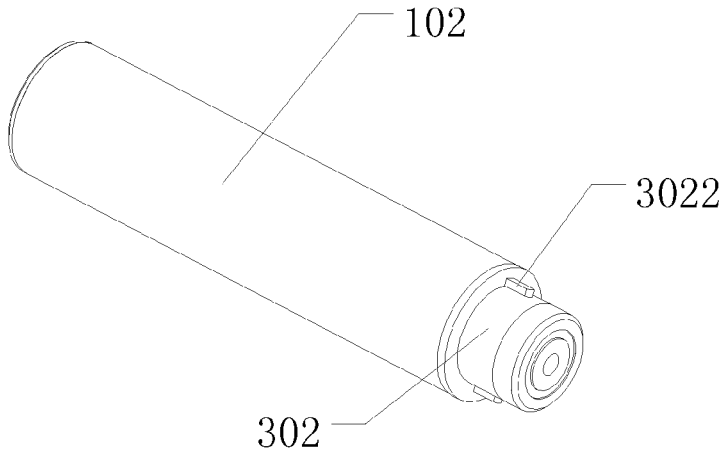
FIG. 5 is a structural view of the atomizing assembly of the electronic cigarette according to another embodiment of the present application.
Figure 6:
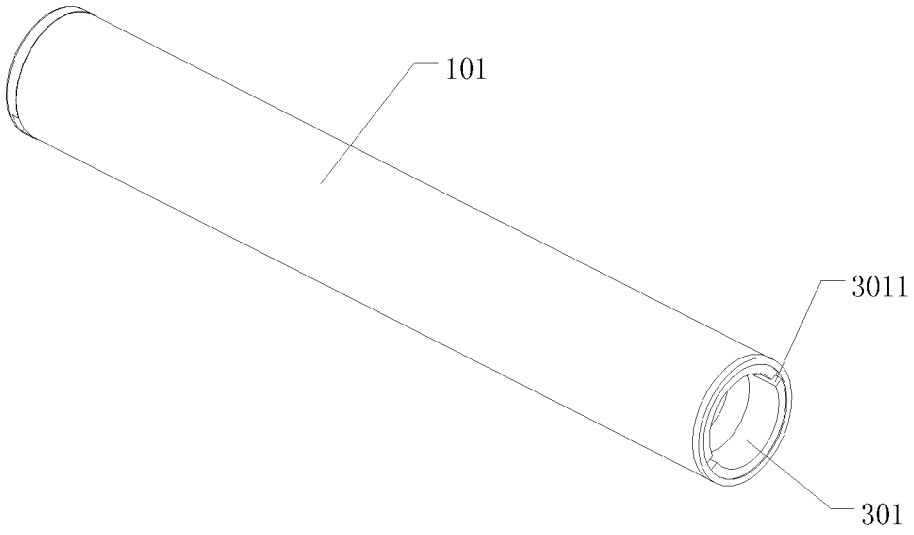
FIG. 6 is a structural view of the battery assembly of the electronic cigarette according to the embodiment of the present application.

A second embodiment of the present application is shown in FIG. 5 and FIG. 6.

In this embodiment, the retaining member is a protruding snap ring 302 which is arranged in the axial direction of the electronic cigarette and has an embossment.

The protruding snap ring 302 is fixedly connected to the atomizer connecting end.

A groove ring 301 is provided in the accommodating cavity of the battery connecting end and is configured to cooperate with the protruding snap ring 302.

The groove ring 301 is provided with a guiding retaining groove 3011 in the axial direction of the electronic cigarette, and the guiding retaining groove 3011 allows the embossment 3022 of the protruding snap ring 302 to be inserted therein, to prevent the mutual rotation of the atomizing assembly 102 and the battery assembly 101.

The protruding snap ring 302 is mounted on the atomizer connecting end 1022. The groove ring 301 may be formed integrally, and may also be formed by several arcs mounted in the hollow cylinder of the battery connecting end 1011. By this way, after the atomizing assembly 102 is connected to the battery assembly 101, the embossment 3022 of the protruding snap ring 302 and the groove 3011 of the groove snap ring 301 may cooperate with each other to prevent the mutual rotation.

In this embodiment, the protruding snap ring 302 is made of an annular member, the annular member is provided with at least one embossment 3022, and the embossment 3022 has a corner angle. The number of the embossment 3022 can be two or three, or etc., which is not limited herein. The groove 3011 of the groove snap ring 301 matches with the embossment 3022 of the protruding snap ring 302, the number of the groove 3011 can be more than the number of the embossment 3022, and the specific relationship between the numbers of the groove and the embossment 3022 is not limited herein. The length of the embossment 3022 in the axial direction of the atomizing assembly is less than or equal to the length of the groove 3011. The length of the embossment 3022 in the axial direction of the atomizing assembly is less than or equal to the length of the atomizer connecting end, but the minimum length of the embossment 3022 should not be less than a half of the length of the atomizer connecting end, since the effect of preventing the mutual rotation realized by the embossment 3022 will be affected adversely in the case that the length of the embossment 3022 in the axial direction of the atomizing assembly is less than a half of the length of the atomizer connecting end.

In this embodiment, the protruding snap ring 302 and the groove snap ring 301 are made of plastic material.

The protruding snap ring 302 is contacted to the atomizer connecting end 1022 or the battery connecting end 1011 by injection molding.

The groove snap ring 301 may be integrally formed and then slotted to form the groove, or, the ring may be formed by several parts, then the several parts of the ring are connected to the connecting end by injection molding with intervals therebetween, thereby forming the groove 3011.

The groove snap ring 301 is connected to the atomizer protruding snap ring 1022 or the battery connecting end 1011 by injection molding.

In this embodiment, the protruding snap ring 302 and the groove snap ring 301, which are made of plastic material, are formed integrally in the mould to facilitate processing, and it is not required to machine the shape of a corner angle on the connecting ends of the atomizing assembly 102 and the battery connecting end 101, thus in the process of producing the electronic cigarette, the process can be reduced, the production process can be simplified, and the productivity can be increased.

In this embodiment, the protruding snap ring 302 and the groove snap ring 301 after being produced are fixedly connected to the connecting ends by injection molding respectively, and this connection has a strong adhesion. After the injection molding is finished, this manner has the same effect as the structure in other embodiments that the member with the corner angle is integrally formed with the connecting end. The mutual rotation of the atomizing assembly 102 and the battery assembly 101 can be prevented by the interaction between the protruding snap ring 302 and the groove snap ring 301.

In a third embodiment of the present application, the atomizer connecting end 1022 is a solid polygonal prism.

The battery connecting end 1011 is a hollow polygonal prism which is configured to cooperate with the atomizer connecting end 1022.

In this embodiment, the corner angle is an angle included by two edges of the polygonal prism, and is configured to prevent the mutual rotation of the atomizing assembly 102 and the battery assembly 101.

In this embodiment, the atomizer connecting end 1022 can be a hollow polygonal prism, and the battery connecting end 1011 can be a solid polygonal prism which is configured to cooperate with the atomizer connecting end 1022. The above two manners only have structural change, and both use the corner angle to prevent the mutual rotation.

In the embodiment, the hollow polygonal prism and the solid polygonal prism can be a trilateral polygonal prism or a quadrilateral polygonal prism. Of cause, the polygonal prism may also be a quinquelateral polygonal prism or a hexagonal polygonal prism, and etc., which is not limited herein. However, when the polygonal prism has excessive edges, the effect for preventing the rotation may be affected. The polygonal prism having excessive edges is similar to a circle, thus the atomizing assembly 102 and the battery assembly 101 can rotate with respect to each other. Therefore, it is preferable that a quadrilateral polygonal prism is used.

In this embodiment, an embossment can be arranged on the end surface of the connecting end of the polygonal prism, and a groove for receiving the embossment may be arranged in the accommodating cavity of the polygonal prism, which can more effectively prevent the mutual rotation of the atomizing assembly 102 and the battery assembly 101. The embossment may be a magnet, and the wall of the groove may be made of magnetic material.

In this embodiment, the atomizing assembly 102 is connected to the battery assembly 101 by magnetic attraction. The connecting ends of the atomizing assembly 102 and the battery assembly 101 are both a polygonal prism, and the shape of the main body of the electronic cigarette can be a cylinder, which is not limited herein.

In this embodiment, the atomizer connecting end 1022 may be a hollow polygonal prism which is configured to cooperate with the battery connecting end 1011 and to allow the battery connecting end to be inserted therein. The battery connecting end 1011 may be a solid polygonal prism. In this manner, only the structures of the connecting ends of the atomizing assembly 102 and the battery assembly 101 are changed, and the working manner and the function are the same as the above manner, thus will not be repeated herein.

Figure 7:
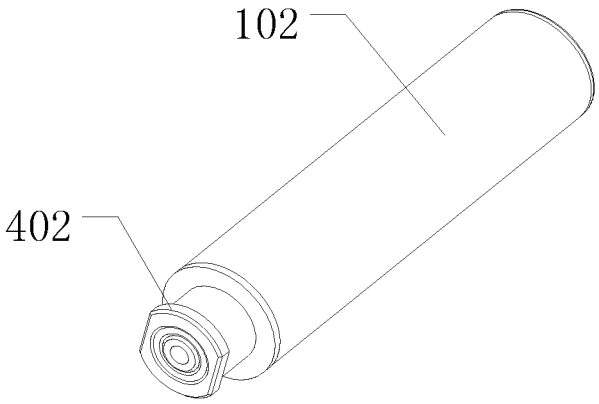
FIG. 7 is a structural view of the atomizer connecting end of the electronic cigarette according to another embodiment of the present application.
Figure 8:
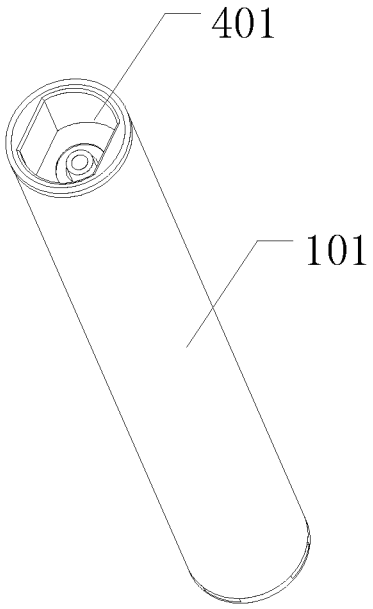
FIG. 8 is a structural view of the battery connecting end of the electronic cigarette according to the embodiment of the present application.

Referring to FIG. 7 and FIG. 8, a fourth embodiment is provided according to the present application.

In this embodiment, the atomizer connecting end 1022 is an arched body 402 which is formed by cutting a part of arc body from a cylinder along at least one section; and the battery connecting end 1011 is an arched groove 401 which is formed by cutting a part of arc body from a cylinder along at least one section. A part of arc is cut at one side of the cylinder, thus a corner angle is formed on the cylinder, and the corner angle can avoid the mutual rotation of the atomizing assembly 102 and the battery assembly 101.

In this embodiment, a part of arc body can be cut along one or two sections, and also can be cut along three sections, and etc., which is not limited herein. The section is cut completely along with the connecting end. The section can be located between a quarter and a half of the length of the radius of the circular section of the cylinder, and is preferably located at one-third of the radius of the section of the cylinder. If the position of the section does not exceed a half of the radius or exceeds a quarter of the radius, the restraining force for restraining the mutual rotation of the atomizing assembly 102 and the battery assembly 101 will be affected adversely, and the above-described effect can not be achieved.

In this embodiment, the atomizer connecting end is an arched groove 401 which is formed by cutting a part of arc body from a cylinder along at least one section, and the battery connecting end is an arch body 402 which is formed by cutting a part of arc body from a cylinder along at least one section. This solution is obtained by structural exchanging, which realizes the same effect as the above solution, thus will not be repeated herein.

The above embodiments are only used to facilitate understanding the technical solution in the present application, and are not intended to constitute any limitation. The following embodiments can be applied to any of the above embodiments.

In the above embodiments, the outer portion of the battery assembly is provided with a first mark configured to indicate the position of the component with the corner angle; the outer portion of the atomizing assembly is provided with a second mark configured to indicate the position of the component with the corner angle. With the first mark and the second mark, the user may conveniently insertedly connect the corner angles of the atomizing assembly 102 and the battery assembly 101 according to the marks.

The marks can be designed as a mark with a LOGO, that is, the mark of the LOGO is printed separately on the outer portion of the atomizing assembly 102 and the outer portion of the battery assembly 101 at positions corresponding to the corner angles of the connecting ends. After the battery assembly 101 and the atomizing assembly 102 are connected by the user, the complete LOGO will appear on the body of the electronic cigarette. By this way, it can be convenient for the user to assemble the electronic cigarette, and also can advertise the electronic cigarette.

In the present application, the second magnetic member of the battery connecting end is a magnet, and the first magnetic member of the atomizer connecting end is made of magnetic material; alternatively, the second magnetic member of the battery connecting end is made of magnetic material, and the first magnetic member of the atomizer connecting end is a magnet. The arrangement is not limited herein.

In the present application, the retaining member 112 is a magnet functioning as the first magnetic member, and the wall of the guiding retaining groove 111 is made of magnetic material and functions as the second magnetic member; alternatively, the retaining member 112 is made of magnetic material, and the wall of the guiding retaining groove 111 is a magnet. The arrangement is not limited herein.

In the present application, the battery assembly 101 further includes a spring electrode assembly, which can be referred to FIG. 8.

The spring electrode assembly includes a spring 502, a battery holder 503 and a battery electrode 504.

The spring 502 has one end fixedly connected to the battery holder 503, and another end connected to the battery electrode 504 and configured to, under the action of an external force, make the battery electrode 504 to move telescopically under the action of the spring 502.

The battery electrode 504 can move telescopically under the action of the spring 502, thus after the atomizing assembly is connected to the battery assembly, the connecting end of the atomizing assembly presses the spring 502, which makes the spring 502 generate a counterforce to the atomizing assembly, and the battery electrode 504 can solidly in contact with the electrode of the atomizing assembly under the action of the counterforce. Therefore, the atomizing assembly and the battery assembly have a good conducting effect.

The second magnetic member 501 is connected to the battery holder 503, and is fixed on the battery connecting end.

The atomizing assembly further includes an upper electrode 505.

The upper electrode 505 is made of magnetic material, is connected to the second magnetic member 501 by magnetism attraction, and is configured to connect the atomizing assembly 102 to the battery assembly 101.

In the present application, the second magnetic member 501 is a magnet, and the upper electrode 505 is made of magnetic material; alternatively, the second magnetic member 501 is made of magnetic material, and the upper electrode 505 is a magnet.

In the present application, the battery assembly 101 further includes a connection sleeve 602 and a spring electric motor assembly 601. The atomizing assembly 102 further includes an upper electrode 603 and an inner electrode 604. The connection sleeve 602 and the upper electrode 603, as well as the spring electric motor assembly 601 and the inner electrode 604, are electrically connected respectively, thereby forming a closed circuit, and the closed circuit is configured to allow the battery assembly 101 to supply power to internal components of the atomizing assembly 102.

Figure 9:
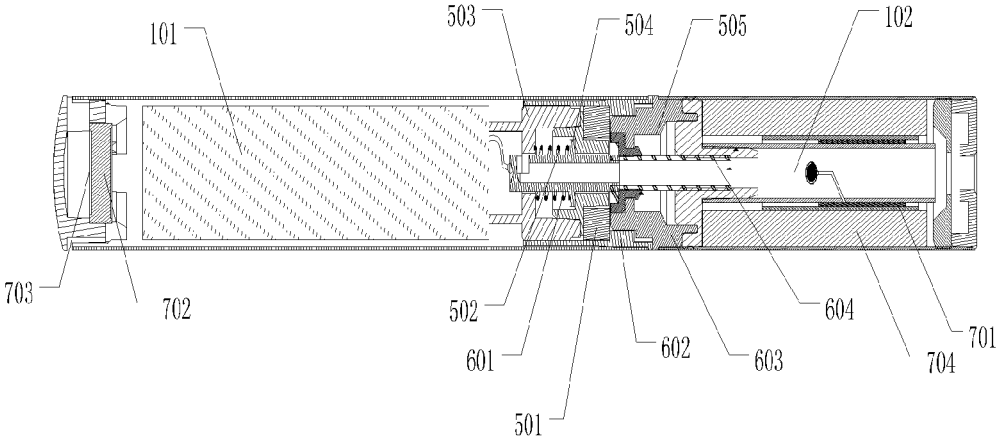
FIG. 9 is an overall sectional view of the electronic cigarette according to another embodiment of the present application.

In the present application, as shown in FIG. 9, after the atomizing assembly 102 is connected to the battery assembly 101, the connection sleeve of the battery assembly 101 and the upper electrode of the atomizing assembly 102, as well as the spring electric motor assembly of the battery assembly 101 and the inner electrode of the atomizing assembly 102, are electrically connected, thereby forming a closed circuit, which allows the battery assembly 101 to supply power to internal components of the atomizing assembly, and also to supply power to a heating wire assembly 701 of the atomizing assembly 102. In this embodiment, the heating wire assembly 701 includes a liquid delivering wick and a heating wire wound on the liquid delivering wick. The liquid delivering wick is pressed against the inner wall of an atomizer liquid storage cotton 704. This implementation can be applied to all of the above embodiments, and this implementation is the manner of supplying power to internal components of the atomizing assembly by the battery assembly 101 in the present application.

In the present application, the battery assembly 101 further includes a control module. The control module is provided with a microcontroller 702 and an airflow sensor 703. The airflow sensor 703 is configured to sense the internal air pressure of the electronic cigarette. While the user smokes, the internal air pressure of the electronic cigarette changes, the airflow sensor 703 sends a pulse signal to the microcontroller 702, and the microcontroller 702 sends a control signal to the heating wire assembly 701 of the atomizing assembly according to the pulse signal, to control the heating wire of the heating wire assembly 701 to generate heat to atomize the cigarette liquid in the liquid storage cotton 704 and generate smoke. In this way, the electronic cigarette finishes one smoking process. This implementation can be applied to all of the above embodiments, and this implementation is the working process of the electronic cigarette in the present application.

The above embodiments are described in a progressive and parallel manner. Each of the embodiments is mainly focused on describing its differences from other embodiments, and references may be made among these embodiments with respect to the same or similar portions among these embodiments.

Based on the above description of the disclosed embodiments, the person skilled in the art is capable of carrying out or using the present application. It is obvious for the person skilled in the art to make many modifications to these embodiments. The general principle defined herein may be applied to other embodiments without departing from the spirit or scope of the present application. Therefore, the present application is not limited to the embodiments illustrated herein, but should be defined by the broadest scope consistent with the principle and novel features disclosed herein.

The invention claimed is:

1. An electronic cigarette, comprising a battery assembly and an atomizing assembly, wherein, the atomizing assembly is provided with an atomizer connecting end configured to be connected to the battery assembly, and the atomizer connecting end is provided with a first magnetic member;

the battery assembly is provided with a battery connecting end configured to cooperate with the atomizer connecting end, and the battery connecting end is provided with a second magnetic member configured to be connected to the first magnetic member by magnetism attraction; and the battery connecting end is provided with an accommodating cavity which allows the atomizer connecting end to be inserted therein; a side wall of the accommodating cavity is provided with a guiding retaining groove which extends along an axial direction of the electronic cigarette to an end surface of an opening of the accommodating cavity, and a wall of the guiding retaining groove is provided with a corner angle; the atomizer connecting end is provided with a retaining member configured to be inserted in the guiding retaining groove, and the retaining member has a corner angle and is configured to abut against the guiding retaining groove to prevent mutual rotation of the atomizing assembly and the battery assembly; or, the atomizer connecting end is provided with the accommodating cavity which allows the atomizer connecting end to be inserted therein; a side wall of the accommodating cavity is provided with the guiding retaining groove; and the battery connecting end is provided with the retaining member; and the retaining member is a protruding snap ring provided with an embossment along the axial direction of the electronic cigarette;

the protruding snap ring is fixedly connected to the atomizer connecting end;

the accommodating cavity of the battery connecting end is provided with a groove ring configured to cooperate with the protruding snap ring;

a wall of the groove ring is provided with a guiding retaining groove; and the guiding retaining groove is configured to allow the embossment of the protruding snap ring to be inserted therein, to prevent the mutual rotation of the atomizing assembly and the battery assembly.

2. The electronic cigarette according to claim 1, wherein, the battery connecting end is provided with a guiding retaining groove seat;

the guiding retaining groove is provided at a side wall of the guiding retaining groove seat; and the retaining member is a protrusion arranged at an outer portion of the atomizing assembly along the axial direction of the electronic cigarette, and the protrusion is configured to be inserted into the guiding retaining groove to prevent the mutual rotation of the atomizing assembly and the battery assembly.

3. The electronic cigarette according to claim 2, wherein, at least one protrusion is provided, and at least two guiding retaining grooves are provided.

4. The electronic cigarette according to claim 2, wherein a length of the protrusion along an axial direction of the atomizer connecting end is less than or equal to an axial length of the atomizer connecting end.

5. The electronic cigarette according to claim 2, wherein, the protrusion is a semicircle with elasticity, and the guiding retaining groove is a semicircular groove.

6. The electronic cigarette according to claim 1, wherein, the protruding snap ring and the groove ring are made of plastic material;

the protruding snap ring and the atomizer connecting end are connected by injection molding; and the groove ring and the battery connecting end are connected by injection molding.

7. The electronic cigarette according to claim 1, wherein, the atomizer connecting end has a polygonal prism structure, and the accommodating cavity of the battery connecting end is a hollow polygonal prism configured to cooperate with the atomizer connecting end and to allow the atomizer connecting end to be inserted therein;

or, the atomizer connecting end is a hollow polygonal prism configured to cooperate with the battery connecting end and to allow the battery connecting end to be inserted therein, and the battery connecting end has a polygonal prism structure.

8. The electronic cigarette according to claim 7, wherein the polygonal prism is a trilateral polygonal prism or a quadrilateral polygonal prism.

9. The electronic cigarette according to claim 7, wherein, an outer portion of the polygonal prism of the atomizer connecting end is provided with an embossment along the axial direction of the electronic cigarette, and the accommodating cavity of the battery connecting end is provided with a groove configured to cooperate with the embossment and to allow the embossment to be inserted therein;

or, the hollow polygonal prism of the atomizer connecting end is provided with a groove, and an outer portion of the polygonal prism of the battery connecting end is provided with an embossment along the axial direction of the electronic cigarette; and the embossment is a magnet; and a wall of the groove is made of magnetic material.

10. The electronic cigarette according to claim 8, wherein, an outer portion of the polygonal prism of the atomizer connecting end is provided with an embossment along the axial direction of the electronic cigarette, and the accommodating cavity of the battery connecting end is provided with a groove configured to cooperate with the embossment and to allow the embossment to be inserted therein;

or, the hollow polygonal prism of the atomizer connecting end is provided with a groove, and an outer portion of the polygonal prism of the battery connecting end is provided with an embossment along the axial direction of the electronic cigarette; and the embossment is a magnet; and a wall of the groove is made of magnetic material.

11. The electronic cigarette according to claim 1, wherein the accommodating cavity of the battery connecting end is an arched groove which is formed by cutting a part of arc body from a cylinder along at least one section and is configured to allow the atomizer connecting end to be inserted therein, and the atomizer connecting end is an arched body which is formed by cutting a part of arc body from a cylinder along at least one section and is configured to cooperate with the arched groove to prevent the mutual rotation of the atomizing assembly and the battery assembly;

or, the battery connecting end is formed by cutting a part of arc body from a cylinder along at least one section, and the atomizer connecting end is an arched groove which is formed by cutting a part of arc body from a cylinder along at least one section and is configured to allow the atomizer connecting end to be inserted therein.

12. The electronic cigarette according to claim 1, wherein, an outer portion of the atomizing assembly is provided with a first mark configured to indicate the position of the retaining member; and an outer portion of the battery assembly is provided with a second mark configured to cooperate with the first mark to indicate the connection location.

13. The electronic cigarette according to claim 1, wherein, the retaining member is a magnet, and a wall of the guiding retaining groove is made of magnetic material;

or, the retaining member is made of magnetic material, and a wall of the guiding retaining groove is a magnet.

14. The electronic cigarette according to claim 1, wherein, the battery assembly further comprises a spring electrode assembly;

the spring electrode assembly comprises a spring, a battery holder and a battery electrode;

the spring has one end fixedly connected to the battery holder, and another end connected to the battery electrode and configured to, under the action of an external force, make the battery electrode to move telescopically under the action of the spring;

the second magnetic member is connected to the battery holder, and is fixed on the battery connecting end;

the atomizing assembly further comprises an upper electrode; and the upper electrode is made of magnetic material and functions as the first magnetic member, and is configured to be connected to the second magnetic member by magnetism attraction, to connect the atomizing assembly to the battery assembly.

15. The electronic cigarette according to claim 14, wherein, the second magnetic member is a magnet, and the upper electrode is made of magnetic material;

or, the second magnetic member is made of magnetic material, and the upper electrode is a magnet.

16. The electronic cigarette according to claim 1, wherein, the battery assembly further comprises a connection sleeve and a spring electric motor assembly;

the atomizing assembly further comprises an upper electrode and an inner electrode; and the connection sleeve and the upper electrode, as well as the spring electric motor assembly and the inner electrode, are electrically connected respectively, to form a closed circuit configured to allow the battery assembly to supply power to internal components of the atomizing assembly.

* * * * *